US011858602B2

(12) United States Patent
Cato

(10) Patent No.: US 11,858,602 B2
(45) Date of Patent: Jan. 2, 2024

(54) REMOVABLE BOAT PROTECTION DEVICE AND METHOD TO USE

(71) Applicant: Jerry Cato, Jacksonville, FL (US)

(72) Inventor: Jerry Cato, Jacksonville, FL (US)

( * ) Notice: Subject to any disclaimer, the term of this patent is extended or adjusted under 35 U.S.C. 154(b) by 263 days.

(21) Appl. No.: 17/378,810

(22) Filed: Jul. 19, 2021

(65) Prior Publication Data

US 2023/0013272 A1 Jan. 19, 2023

(51) Int. Cl.
*B63B 43/18* (2006.01)
*B63B 17/02* (2006.01)
*B63B 17/00* (2006.01)

(52) U.S. Cl.
CPC ..... *B63B 43/18* (2013.01); *B63B 17/02* (2013.01); *B63B 2017/0045* (2013.01)

(58) Field of Classification Search
CPC ..... B63B 43/00; B63B 43/18; B63B 17/00; B63B 17/02
USPC ..... 114/361
See application file for complete search history.

(56) References Cited

U.S. PATENT DOCUMENTS

| | | | | |
|---|---|---|---|---|
| 5,152,242 | A | 10/1992 | Bradley | |
| 5,343,824 | A * | 9/1994 | Floyd | B63B 17/02 114/361 |
| 5,660,137 | A | 8/1997 | Manley | |
| 6,672,241 | B2 | 1/2004 | Warfel | |
| 7,004,100 | B1 * | 2/2006 | Rard | B63B 17/00 114/364 |
| 7,377,227 | B2 | 5/2008 | LaRoche | |
| 7,455,023 | B2 | 11/2008 | Gerstenberger | |
| 7,854,211 | B2 | 12/2010 | Rixford | |
| 10,151,032 | B2 | 12/2018 | Thompson | |
| 2006/0063440 | A1 | 3/2006 | Hutchinson | |
| 2011/0120362 | A1 | 5/2011 | Costas | |

* cited by examiner

*Primary Examiner* — Lars A Olson
(74) *Attorney, Agent, or Firm* — Lawrence J. Gibney, Jr.

(57) ABSTRACT

The protective cover as described will protect the outer surface of a vessel from debris that may strike the vessel either in the water or during sporting events such as fishing. Any damage to a boat is typically expensive and time consuming and is generally to be avoided by the boat owner.

5 Claims, 3 Drawing Sheets

REMOVABLE BOAT PROTECTION DEVICE AND METHOD TO USE

BACKGROUND OF THE INVENTION

A. Field of the Invention

This relates to a device that will protect the outer surface of a boat particularly on the exterior surface above the waterline. The device can be removed at will in the event the cover is not needed.

B. Prior Art

There are prior art references to devise that will protect the hull of a vessel. A representative example of this can be found at Gerstenberger, U.S. Pat. No. 7,455,023. The Gerstenberger reference protects the hull of the vessel below the water line and not the top surface. Another reference can be found at Thompson, U.S. Pat. No. 10,151,032. The Thompson reference is a protective cover in general, is not specific to a boat, and does not take the shape to snugly fit over the stop surface of the boat. Another reference is Bradley, U.S. Pat. No. 5,152,242, which is a portable hull structure that protects the boat's surfaces below the water line but not above the water line. Additionally, with the Bradley device, the boat cannot be operated if this device is in use, and the device does not snugly fit around the surface of the boat.

BRIEF SUMMARY OF THE INVENTION

Boats are expensive items, and the owner of a boat goes to great expense to take proper care of the boat. One area that is frequently damaged is the outside surface of the boat either below the waterline or above the waterline.

The boat's surfaces are exposed to debris that can be found floating in the water, either on the water surface or below the water surface. Damage to the exterior surface of the boat can also occur when objects strike the outside cover of the vessel. This can occur if the boat hits a dock for example or the boat can strike floating debris. Another way that the outer surface of the boat can be damaged is when the occupants engage in a sporting event such as fishing. The tackle may strike the outer surface of the boat. The interior of the boat is not subject to the same type of damage.

This is a protective cover which will fit snugly over the shell of the vessel but leaves the interior space open for normal use. It will be custom made to fit a particular vessel and will be constructed of rigid fiberglass material or another type of composite material. The device will likely be in sections so that the user is able to only use sections if that is all that is needed. Regardless of the type of material that will be used for the device, the choice of material will be selected to withstand extremes in temperature and all types of environmental conditions. Another consideration of the choice of material is that the material should be lightweight to avoid adding a significant amount of weight to the boat.

When the boat is in operation, the device should fit somewhat over the gunwale railing of the boat and snugly fit around the contours of the vessel and slightly above the water line. The device will not produce drag that would slow down the vessel or interfere with the normal operation of the boat. When the device is not to be used, the device can be removed from the vessel and stored in an appropriate location.

The user of this device may also post advertising material on the outside of the device if the user wanted to promote a service or product.

NUMBERING DESCRIPTION

5—Boat
10—Cover
15—Water Line
20—Inner Edge
25—Outer Edge
30—Sections

DETAILED DESCRIPTION OF THE EMBODIMENTS

Figure 3:
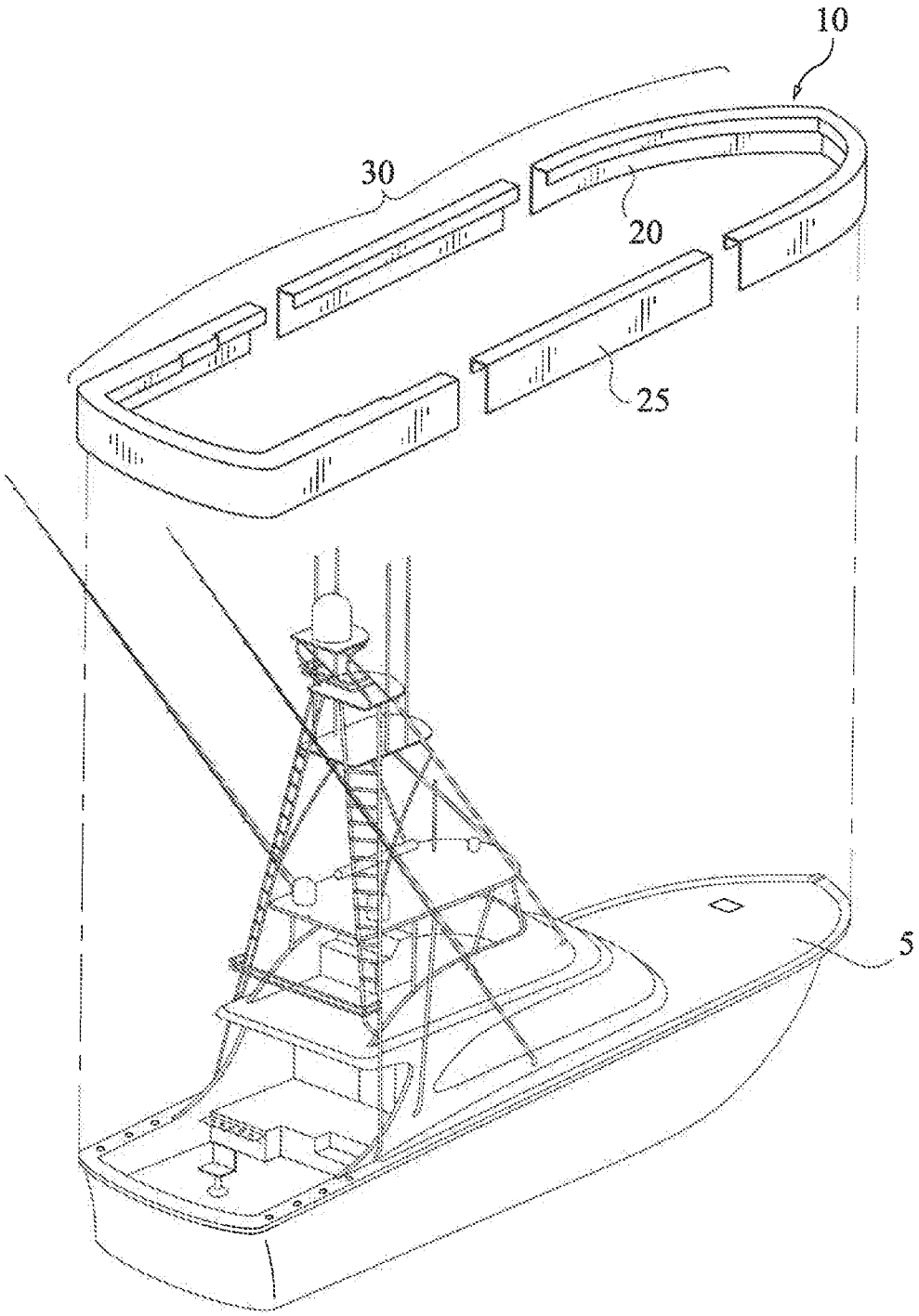
FIG. 3 is an isometric view of the cover in sections that can be placed over the vessel.

This is a protective cover 10 which will cover the outside surfaces of a boat 5. The cover 10 will be custom made depending on the type of boat 5 and may cover all the surfaces of the boat or may be tailor made to cover only a portion of the surfaces. Alternatively the device may be in sections 30 that cover a specific boat. The advantage of using sections is to allow the user to use only those sections that may be needed or desired. The use of sections 30 would assist in the storage of the device when the device is not in use. In FIG. 3 three sections are depicted but more or fewer sections may be used depending on the desires of the user.

Every boat will have an outside surface and an interior surface. The outside surface is directly exposed to the water and the interior surface is a space for the occupants of the boat.

All boats have different configurations in terms of the shape of the boat as well as contours of the boat. Even though this is a custom-made device, it will attach to all types of boats in the same manner. For purposes of illustration only a small jon boat is depicted in FIGS. 1 and 2; the concept of using this type of device may be used on any type of vessel.

Figure 1:
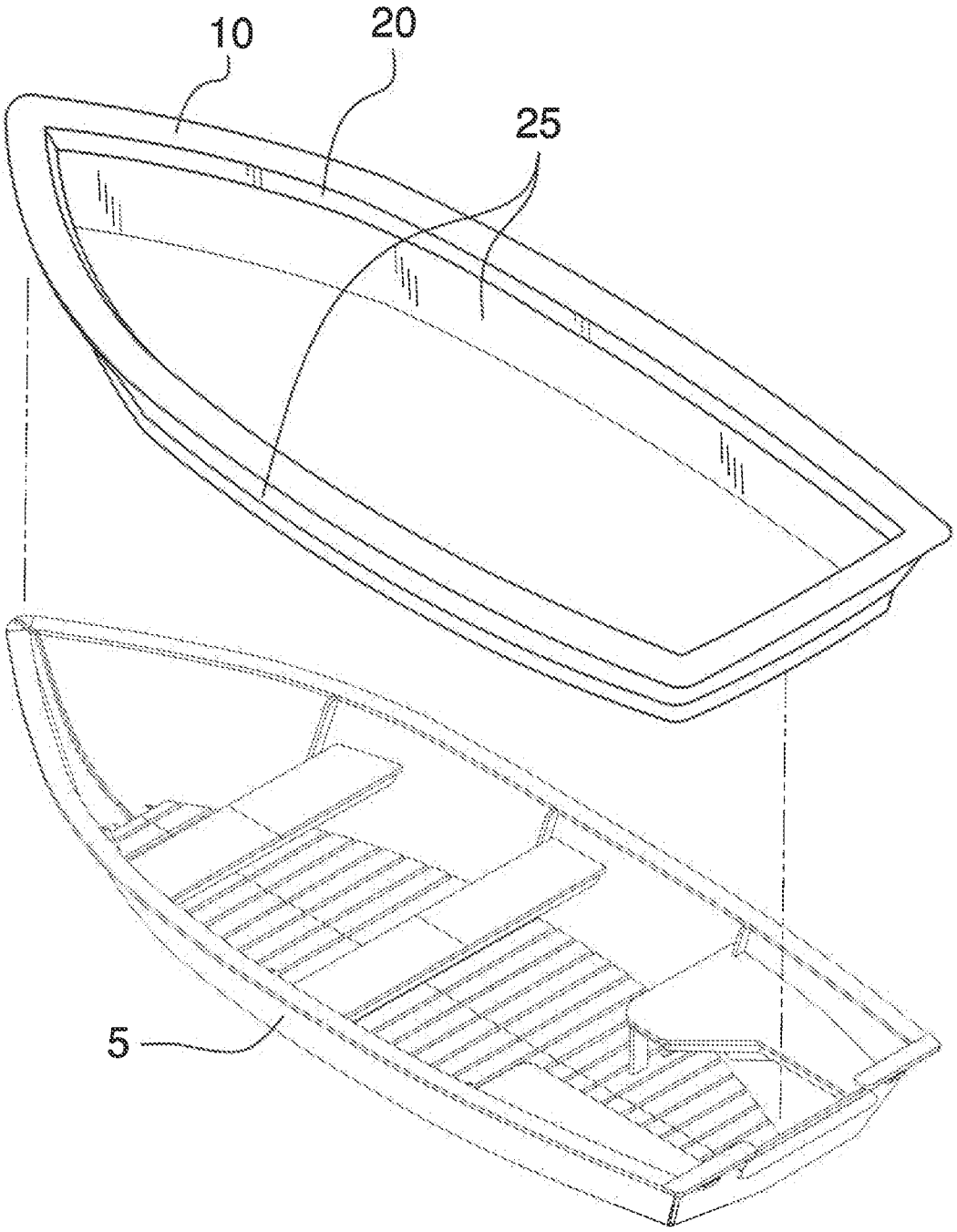
FIG. 1 is an isometric view of the vessel with the cover placed above the vessel depicted in sections.
Figure 2:
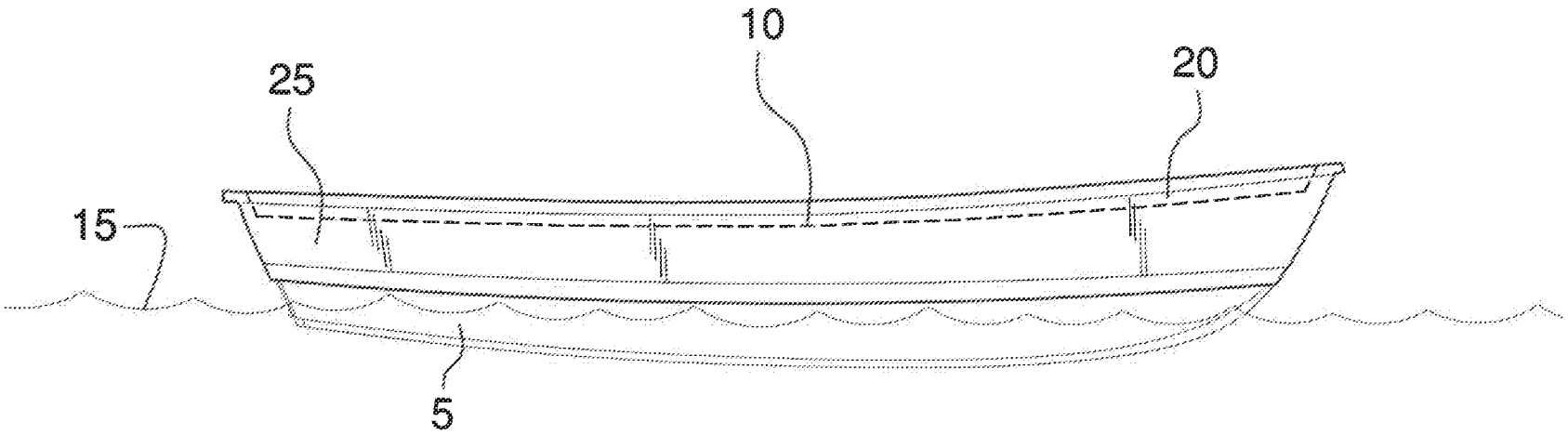
FIG. 2 is a side view of the vessel when in use showing the boat contours as well as the cover and the water line.

According to FIG. 1, this is a shell that will be placed over the outside surface of the boat with a hollow section for the interior of the boat. An inner edge 20 and an outer edge 25 are provided. A small lip will be formed by the outer edge 25 and inner edge 20; the lip will be placed over the top surface or gunwale of a particular boat. The small portion of the lip will permit the device to be attached to the vessel without the use of hardware. The inner edge 20 will lie flush with a portion of the interior of the boat. The outer edge 25 will be placed flush against the outside surface of the boat. The entire cover 10 will fit snugly over the boat. A portion of the cover 10 will be placed over the top gunwale of the boat and extend a predetermined distance into the interior of the boat. Regardless of the type of material that is chosen for this device, the material should be able to withstand extremes in temperatures and withstand shocks from striking objects. A hard composite material or fiberglass are likely suitable materials although the specific type of material is not being claimed.

FIG. 3 represents the device on a sport fishing boat 5 that is commonly used in fishing tournaments. FIG. 3 depicts the device in sections 30. The use of multiple sections allows the user to use as many sections as desired. Although six individual pieces are depicted in three separate sections more or fewer sections may be used with this device.

The device will not interfere with the operation of the boat, nor will it interfere with the configuration of the interior of the vessel. The device will be lightweight and is designed to be portable depending on the desires of the consumer. The device will also be custom made for a specific vessel.

The device will fit snugly against the outer shell of the boat and will rest on the outer surface of the vessel slightly above the waterline of the vessel. The device will be lightweight and will not add a great amount of weight to the boat. It will remain above the water line of the vessel and will not produce drag because it is not designed to constantly contact the surface of the water when the boat is operated.

The cover 10 will be placed slightly above the water line so that it does not interfere with the operation of the boat.

The cover 10 will be made from material that can withstand all extremes in temperatures and is suitable to be exposed to all environmental conditions.

Additionally, the cover 10 should also be able to withstand moderate to high impacts from devices in the water or from flying debris such as pieces of floating debris or sports tackle equipment such as fishing tackle.

When the device is not in use, the cover 10 can be lifted off the boat and stored in an appropriate location. It is designed to be easily washable and easily cleaned.

Additionally, a means to advertise products or services can also be placed on the outside surface of the cover, if desired by the user.

While the embodiments of the invention have been disclosed, certain modifications may be made by those skilled in the art to modify the invention without departing from the spirit of the invention.

The inventor claims:

1. A protective cover for a boat which is comprised of:

a. a cover;

wherein the cover is specifically made for a specific type of boat;

wherein the cover is made from a material that can withstand extremes in temperatures;

wherein the cover has an inner edge;

wherein the cover has an outside edge;

a lip;

wherein the lip is formed by the outer edge and the inner edge;

wherein the lip of the cover is placed over the gunwale of the vessel;

wherein the cover is not attached to the gunwale of the boat;

wherein the cover will fit snugly over the contours of the vessel;

wherein the interior of the protective cover is hollow;

wherein the edge of the cover will extend slightly above the water line once installed;

wherein the edge of the cover will fit over the gunwale of the boat a predetermined amount;

wherein the cover fits snugly over the outside surface of the boat;

wherein the interior of the cover is hollow;

wherein the cover will not interfere with the configuration of the interior of the vessel.

2. A protective cover for a boat as described in claim 1 wherein the cover is washable.

3. A protective cover for a boat as described in claim 1 wherein the cover is portable.

4. A protective cover for a boat as described in claim 1 wherein advertising can be placed on the outside surface of the protective cover.

5. A protective cover for a boat as described in claim 1 wherein the cover is sectional.

* * * * *